United States Patent [19]

Mollura

[11] Patent Number: 4,679,264

[45] Date of Patent: Jul. 14, 1987

[54] AIRBED MATTRESS INCLUDING A REGULATED, CONTROLLABLE AIR RESERVOIR THEREFOR

[76] Inventor: Carlos A. Mollura, 2824 Del Oro La., Fullerton, Calif. 92635

[21] Appl. No.: 846,857

[22] Filed: Apr. 1, 1986

Related U.S. Application Data

[63] Continuation-in-part of Ser. No. 731,450, May 6, 1985, abandoned.

[51] Int. Cl.[4] ..... A47C 27/10

[52] U.S. Cl. ..... 5/453; 5/455; 92/92; 417/37; 417/44

[58] Field of Search ..... 5/453, 454, 455, 456, 5/457, 449; 297/DIG. 3; 417/37, 44; 60/418; 92/92

[56] References Cited

U.S. PATENT DOCUMENTS

| | | | |
|---|---|---|---|
| 184,487 | 11/1876 | White | 5/451 |
| 254,265 | 2/1882 | Bone | 5/451 |
| 486,696 | 11/1892 | Curlin . | |
| 622,239 | 4/1899 | Lane . | |
| 660,466 | 10/1900 | Sawtell . | |
| 679,680 | 7/1901 | Langer . | |
| 684,554 | 10/1901 | Sawtell . | |
| 954,284 | 4/1910 | Hecht . | |
| 1,446,290 | 2/1928 | Dessau . | |
| 1,970,502 | 8/1934 | Hamza . | |
| 2,000,873 | 5/1935 | Arens . | |
| 2,136,510 | 11/1938 | Jensen | 5/456 |
| 2,245,909 | 6/1941 | Enfiajion . | |
| 2,360,715 | 10/1944 | Perry . | |
| 2,682,673 | 7/1954 | Myers | 5/436 |
| 2,769,182 | 11/1956 | Nunlist | 5/68 |
| 2,814,053 | 11/1957 | Sevcik . | |
| 2,823,394 | 2/1958 | Smith | 5/455 |
| 2,919,747 | 1/1960 | Post . | |
| 2,987,735 | 6/1961 | Nail . | |
| 3,029,109 | 4/1962 | Nail | 297/109 |
| 3,059,249 | 10/1962 | Kamp | 5/246 |
| 3,112,956 | 12/1963 | Schick et al. | 5/455 |
| 3,303,518 | 2/1967 | Ingram | 5/456 |
| 3,326,601 | 6/1967 | Vanderbilt et al. | 297/284 |
| 3,335,045 | 8/1967 | Post . | |
| 3,363,941 | 1/1968 | Wierwille | 297/284 |
| 3,485,240 | 12/1969 | Fountain | 128/33 |
| 3,585,356 | 6/1971 | Hall | 5/451 |
| 3,587,568 | 6/1971 | Thomas | 128/33 |
| 3,605,136 | 9/1971 | Vichness et al. | 5/8 |
| 3,605,145 | 9/1971 | Graebe | 5/455 |
| 3,644,956 | 2/1972 | Parker | 15/250.16 |
| 3,705,429 | 12/1972 | Nail | 297/284 |
| 3,792,501 | 2/1974 | Kery | 5/12 R |
| 3,879,776 | 4/1975 | Solen | 5/453 |
| 3,919,730 | 11/1975 | Regan | 5/243 |
| 3,999,539 | 12/1976 | Meador | 5/451 |
| 4,067,078 | 1/1978 | Winston | 5/455 |
| 4,073,021 | 2/1978 | Carlisle | 5/450 |
| 4,078,842 | 3/1978 | Zur | 297/DIG. 3 |
| 4,109,333 | 8/1978 | Zmiarovich | 5/451 |
| 4,189,181 | 2/1980 | Noble et al. | 5/455 |
| 4,190,286 | 2/1980 | Bently | 297/DIG. 3 |
| 4,224,706 | 9/1980 | Young et al. | 5/449 |
| 4,306,322 | 12/1981 | Young et al. | 5/449 |
| 4,394,784 | 7/1983 | Swenson et al. | 5/453 |
| 4,521,166 | 6/1985 | Philips | 5/454 |
| 4,542,547 | 9/1985 | Sato | 5/453 |

FOREIGN PATENT DOCUMENTS

| | | | |
|---|---|---|---|
| 274162 | 10/1965 | Australia | 5/455 |
| 638334 | 3/1962 | Canada . | |
| 901185 | 5/1972 | Canada . | |
| 651612 | 6/1963 | Italy . | |
| 787421 | 12/1957 | United Kingdom | 5/457 |
| 1545806 | 5/1979 | United Kingdom | 5/455 |

*Primary Examiner*—Alexander Grosz
*Attorney, Agent, or Firm*—Kendrick, Netter & Bennett

[57] ABSTRACT

An airbed mattress and support system includes an air reservoir and a device for controllably delivering air to the airbed mattress and for controlling and for maintaining, as the user desires, the air pressure in the airbed mattress.

14 Claims, 8 Drawing Figures

FIG. 1
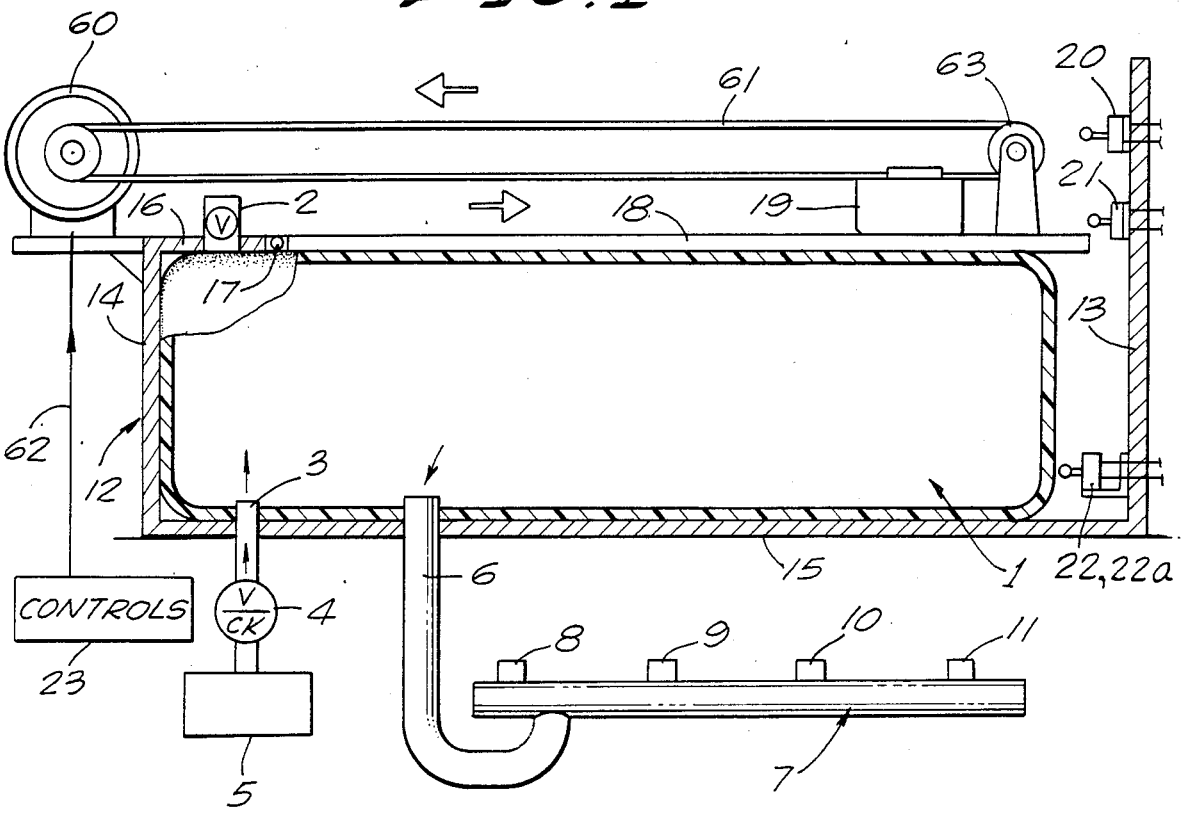
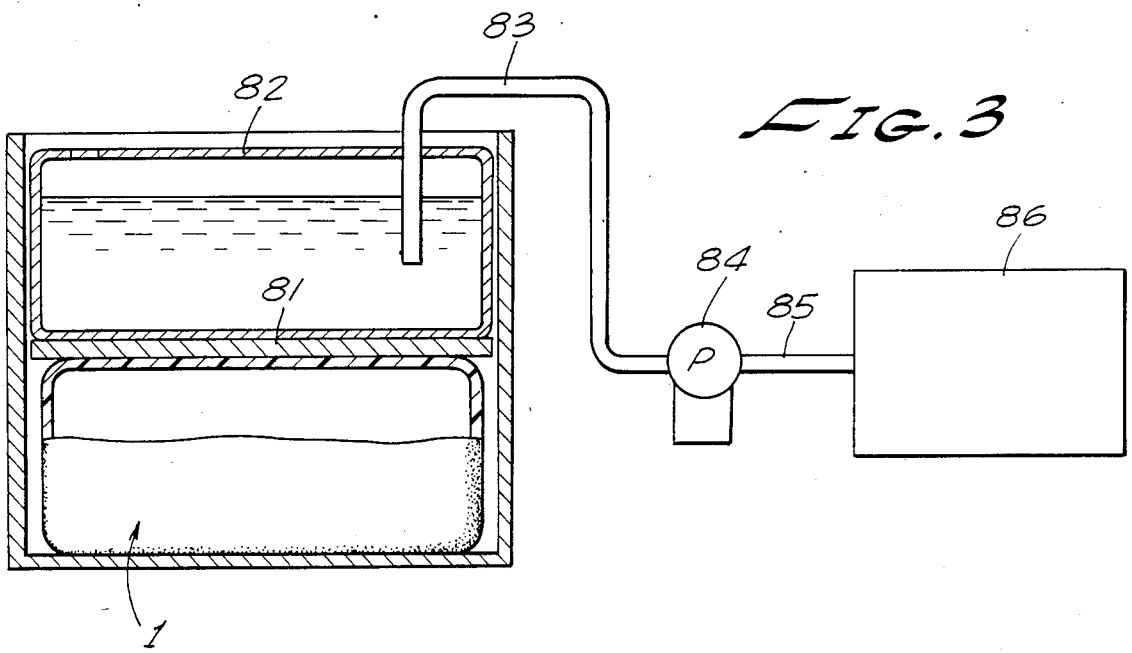
FIG. 3

AIRBED MATTRESS INCLUDING A REGULATED, CONTROLLABLE AIR RESERVOIR THEREFOR

This patent application is a continuation-in-part of U.S. patent application Ser. No. 731,450, filed May 6, 1985, now abandoned, and entitled, "Airbed Mattress System Including a Regulated, Controllable Air Reservoir Therefor." By this reference, I incorporate in this specification the entire disclosure of that application.

This invention relates to an airbed mattress and support system that includes novel air reservoir means for controllably delivering air to the airbed mattress, and for controlling, as the user desires, the air pressure in the airbed mattress.

The invention broadly comprises an air reservoir means including a flexible container that includes air inlet and air outlet means, means for feeding air into the flexible container, and means for maintaining, automatically, a constant, controllable pressure inside the air reservoir means, and inside an airbed mattress linked to the air reservoir means.

The invention includes air reservoir means comprising air inlet means, air outlet means, and preferably, air volume relief means. Linked to the air reservoir means are controllable means for propelling air through the air inlet means. The air reservoir means, in preferred embodiment, fits into means for framing the air reservoir means that includes means, preferably movable means, in contact with the air reservoir means, for exerting controllable pressure on the reservoir means; means for starting the means for propelling air into the air reservoir means through the air inlet means; means for stopping, or turning off, means for propelling air through the air inlet means into the air reservoir means; and, preferably, means for opening and closing the air volume relief means in the air reservoir means.

The controllable, preferably movable means for exerting pressure on the air reservoir means activates the means for starting the air-propelling means when the air volume in the reservoir falls below a predetermined minimum, and activates means for stopping the air-propelling means when the air volume in the reservoir means rises above a first predetermined maximum level. Preferably, the pressure-exerting means also activates the volume relief means when the air volume in the reservoir means rises to a second predetermined maximum, where the second predetermined maximum is higher than the first.

In one embodiment, the pressure-exerting means is carried on a hinged, planar member that lies atop the reservoir means, and is linked to the framing means. In this embodiment, the pressure-exerting means and the reservoir means may lie within a supporting platform for an airbed mattress, functioning, in effect, as a box spring for the mattress.

In another embodiment, the pressure-exerting means comprises a water-holding means placed atop the reservoir means, and, preferably, separated therefrom by a planar member. Means for pumping water into, and out of the water-holding means from a water reservoir permits incremental adjustment of the pressure-exerting means on the air reservoir means.

In a third embodiment, the pressure-exerting means is movably mounted upon first lever means. In turn, the lever means is linked to the air reservoir means. Movement of the pressure-exerting means along the lever means incrementally increases or decreases the force that the lever means transmits to the air reservoir means, incrementally increasing or decreasing the air pressure inside the the airbed mattress.

In preferred embodiment, the means for starting the air-propelling means, the means for stopping the air-propelling means, and the means for opening and closing the volume relief means are linked to the framing means for the reservoir means, and lie in the path of movement of the hinged, planar member that carries the pressure-exerting means. Where, as preferred, the planar member/pressure-exerting means lies atop the reservoir means, the movement of this combination will follow the movement of the air reservoir means. Thus, as the air reservoir means deflates, the combination will follow. At a predetermined minimum air volume within the reservoir means, the combination engages means for starting the air-propelling means. Thereafter, the air-propelling means begins to inflate the air reservoir means. As the air reservoir means inflates, the combination atop the reservoir rises until its path of movement causes engagement with the means for stopping the air-propelling means at some predetermined maximum air volume.

At a second, higher predetermined air volume, the pressure-exerting means can engage means for opening the volume relief valve to release air from the air reservoir means, precluding over-pressurization and excessive air volume. After sufficient air has escaped from the reservoir through the volume relief means to lower the volume within the reservoir below the second predetermined maximum, the combination, in its downward movement, again engages the means for closing the volume-relief means, causing closure thereof.

These airbed/mattress air reservoir systems may also include means for detecting and means for adjusting the air pressure to a desired value in the air reservoir, the airbed mattress, or both. The air-pressure detecting means generates signals representing the actual air pressure in the reservoir, mattress, or both. These signals pass on path means operatively linking the air-pressure detecting means to means for comparing the actual air pressure to a selected, desired air pressure. The comparing means generates a signal representing the difference, if any, between the actual air pressure and the desired air pressure. The air pressure difference signal then passes to means for activating the air-propelling means, or the air volume release means, to adjust the actual air pressure in the reservoir, mattress, or both, to the desired pressure. A feedback loop circuit, or similar means, can be used to monitor constantly the air pressure in the reservoir, mattress, or both, and to maintain the desired air pressure in one or both at all times. The air-pressure detection means and the air-pressure adjustment means can be analog or digital, and may include computer means for effecting the selection, monitoring and maintenance of selected air pressures.

As alternatives to systems including both the air reservoir means and the airbed mattress, other embodiments of these systems include only the airbed mattress in combination with air pressure detection, selection and maintenance means. In such embodiments, the air-propelling means should, however, be adequate to develop and maintain the desired range of air pressures in the airbed mattress.

In preferred embodiments, the air outlet means from the air reservoir means is linked to an airbed mattress lying atop a container housing the air reservoir means/-framing means, preferably through an air manifold linked to a plurality of air tubes inside the airbed mattress lying in side-by-side array, either longitudinally or transversely of the mattress. Inside the airbed mattress, in preferred embodiments, are a plurality of straps or other means for holding the air tubes in side-by-side array. Inside the peripheral side walls of the mattress are, preferably, one or more stabilizing inserts made of such materials as flexible foam rubber.

In one preferred embodiment, the airbed mattress comprises upper and lower panels joined together by four side panels to form an enclosure. Inside the mattress enclosure is an array of parallel cells in a side-by-side array. The cells are separated from one another by panels extending between the upper and lower panels. These cells can be parallel to the length or to the width of the mattress, in preferred embodiments. Within each cell is an air tube which, when inflated, substantially completely fills the cell. Each air tube means inside the airbed mattress enclosure preferably includes means for detachably linking the tube to manifold means linked, in turn, to the air reservoir means of this invention.

Other embodiments could include a plurality of separate air reservoirs with or without a plurality of air mattresses or other support structures. In such embodiments, separate control of two or more mattresses, or two or more regions within one mattress can be obtained.

The new airbed mattress and air reservoir means of this invention can better be understood by reference to the drawings, in which:

FIG. 1 shows one embodiment of the air reservoir means of this invention;

FIG. 3 shows a second embodiment of a portion of the air reservoir means and of the pressure-exerting means therefor;

Figure 2:
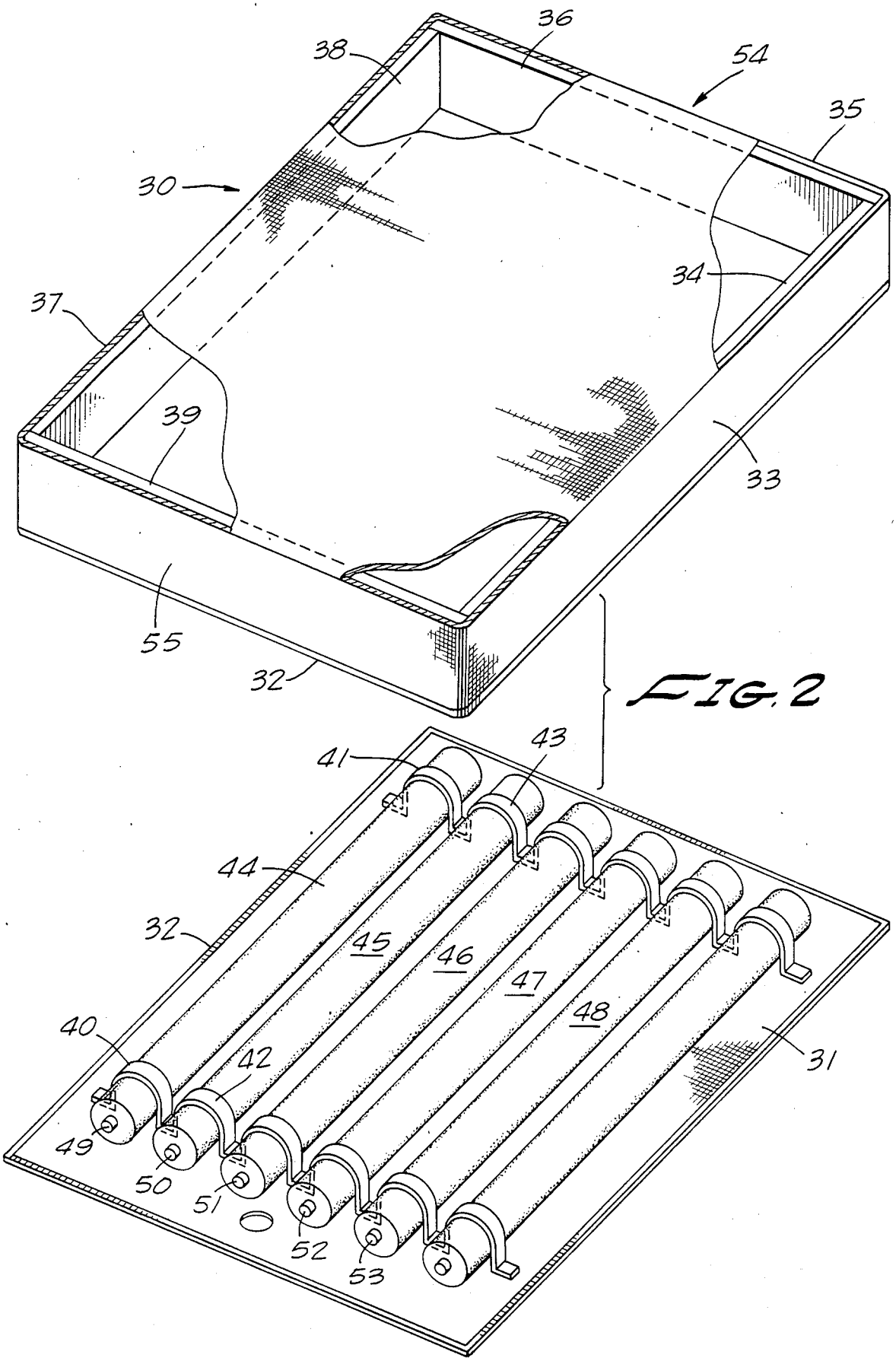
FIG. 2 shows a preferred embodiment of an airbed mattress for use with the air reservoir means shown in FIGS. 1, 3, 4, 5 and 7.

FIG. 1 shows air reservoir means, generally designated 1, including volume relief valve means 2, air inlet means 3, and air outlet means 6. Means are provided for propelling air into air reservoir means 1 via one-way check valve 4 in inlet 3. One-way check valve 4 prevents air from escaping air reservoir means via path 3. Air outlet means 6 from air reservoir means 1 is linked to air manifold 7. Air manifold 7 has a plurality of outlets 8, 9, 10 and 11 for delivering air to a plurality of individual air tubes, as shown in FIG. 2.

FIG. 1 also shows framing means 12 for air reservoir means 1, including end walls 13 and 14, and bottom wall 15. Top wall 16 of framing means 12 includes planar, pressure-transmitting member 18 lying atop air reservoir means 1. Planar member 18, hinged to upper panel 16 of framing means 12 at hinge 17, has a pressure-exerting mechanism 19 movable along planar member 18 toward, and away from hinge means 17.

Linked to end member 13 of framing means 12 are switch 20, which opens volume relief valve means 2 upon engagement with planar member 18; and switch 21, which turns off air-propelling means 5 when planar member 18 engages switch 21 in its upward path of movement, and closes valve 2 in its downward path of movement. Switches 22 and 22*a* turn on air-propelling means 5 upon engagement with planar member 18. Control means 23 turns motor 60 on or off by means of signals carried on path 62. When motor 60 is turned on, weight 19, carried on cable 61, moves between motor 60 and idle roller 63, exerting increasingly lower or higher force on planar member 18, and pressure on air bladder 1, as it moves. This movement permits control of incremental changes in the pressure exerted on reservoir means 1 by the combination of planar member 18 and weight 19. Control means 23 may also include controls to turn power on and off, controls for a heater, and/or controls for indicator lights.

In operation, as air leaves air reservoir means 1 via outlet means 6, the reservoir, which has flexible walls, deflates, and planar member 18 moves downwardly toward switch 22. Upon engagement with switch 22 or with switch 22*a*, air-propelling means 5 turns on, and blower 5 propels air into reservoir 1 via one-way valve 4 and inlet means 3. When planar member 18 rises into engagement with switch 21, switch 21 turns off air-propelling means 5. If, because of one or more persons lying down on the mattress, or for some other reason, air continues to pass into air reservoir means 1 after planar member 18 engages switch 21, planar member 18 continues its upward movement until engagement with switch 20, which opens volume relief valve 2, releasing air from air reservoir 1, deflating reservoir 1, and permitting planar member 18 to drop into engagement with switch 21, closing volume relief valve 2.

FIG. 3 shows a second embodiment of means for exerting pressure on air reservoir means 1. In FIG. 3, water-holding means 82 is placed atop planar member 81 which, in turn, is placed atop air reservoir means 1. Means 84 for pumping water from water tank 86 via lines 85 and 83 into and out of water-holding means 82 permits incremental increases and decreases in the pressure exerted on air reservoir means 1.

Figure 4:
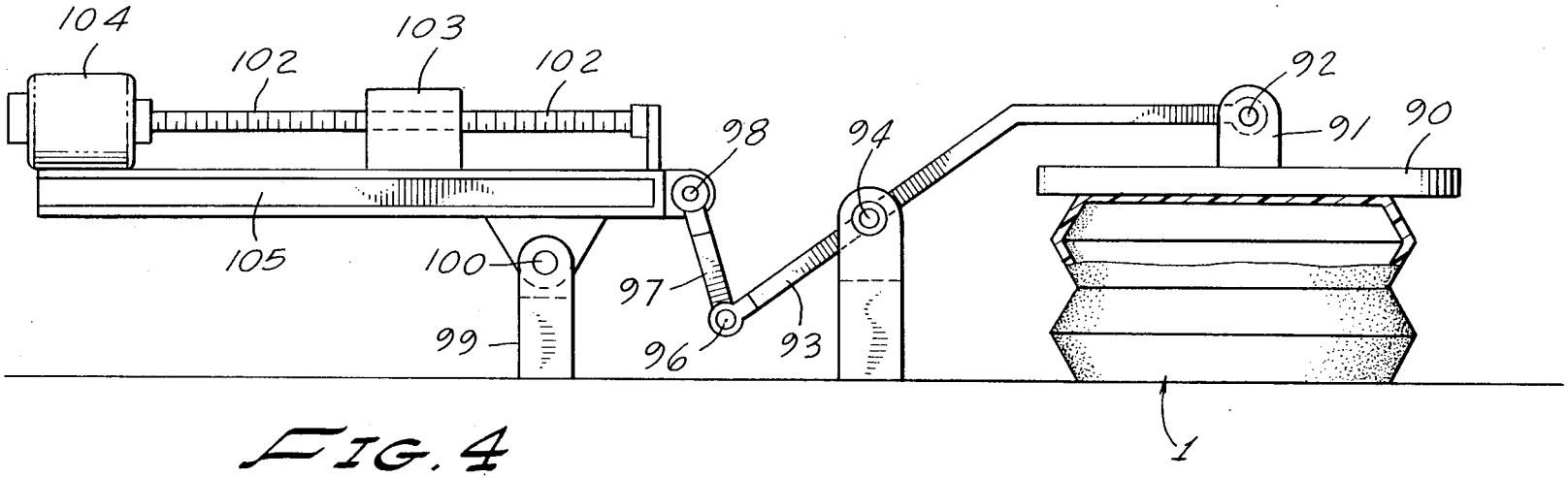
FIG. 4 shows a third embodiment of a portion of the air reservoir means and of the pressure-exerting means therefor.

FIG. 4 shows yet another embodiment of the pressure-exerting means for use in the embodiment of FIG. 1. Lever arm 105 is linked to post 99 at pivot 100. Weight 103 moves along threaded rod 102 from left to right, and vice-versa, when impelled by motor 104. As weight 103 moves along lever arm 105, mechanical arms 97 and 93, linked to lever arm 105 at pivots 98, 96 and 94, exert incrementally increasing or decreasing amounts of force upon panel 90 mounted atop air reservoir means 1. As weight 103 moves to the left in FIG. 4, lever arm 105 moves downwardly, causing pivot 96 to more upwardly and lever 93 to move downwardly at pivot 92, increasing the pressure on air reservoir means 1. Movement of weight 103 to the right in FIG. 4 raises lever arm 93, at pivot 92, incrementally carrying with it panel 90 linked to lever arm 93 through linking means 91 and pivot 92.

Figure 5:
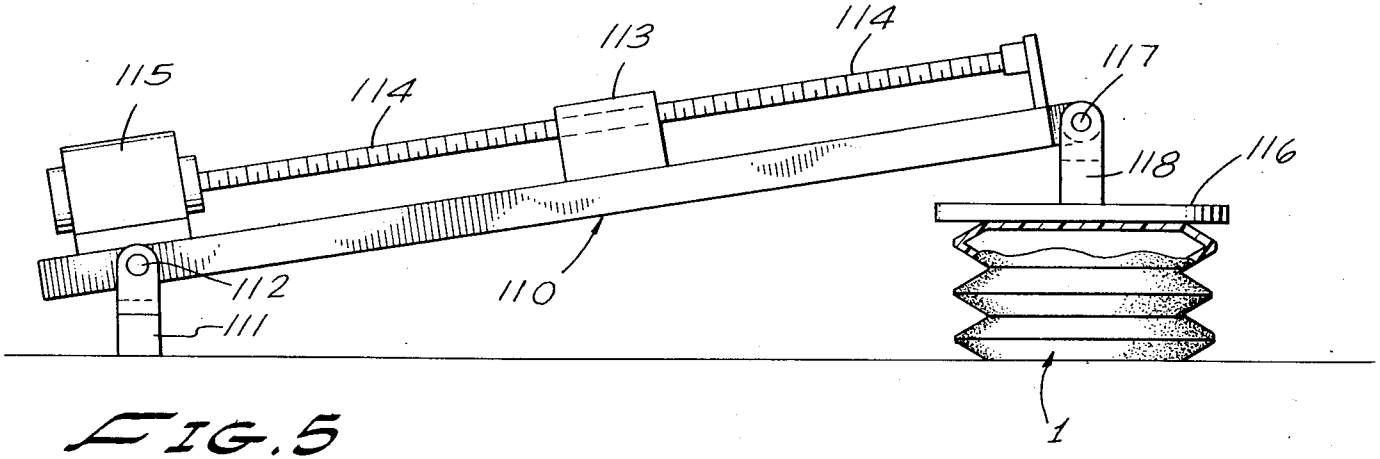
FIG. 5 shows a fourth embodiment of a portion of the air reservoir means, and of the pressure-exerting means therefor.

FIG. 5 shows yet another embodiment of the pressure-exerting means for use in the embodiment of FIG.

1. Lever arm 110 is linked to post 111 at pivot 112. Weight 113 moves along threaded rod 114 from left to right, and vice-versa, when impelled by motor 115. As weight 113 moves along lever arm 110, lever 110 exerts incrementally increasing or decreasing amounts of force upon panel 116 atop air reservoir 1, and upon reservoir 1 itself. As weight 113 moves to the left in FIG. 5, lever arm 110 moves upwardly, causing panel 116 to move upwardly through the gradually decreasing force exerted thereon by lever arm 110. Lever arm 110 is joined to linking member 118 attached to the top of panel 116 at pivot 117. Movement of weight 113 to the right in FIG. 5 moves arm 110 incrementally downwardly, carrying with it panel 116, and increasing incrementally the pressure on air reservoir 1.

Figure 7:
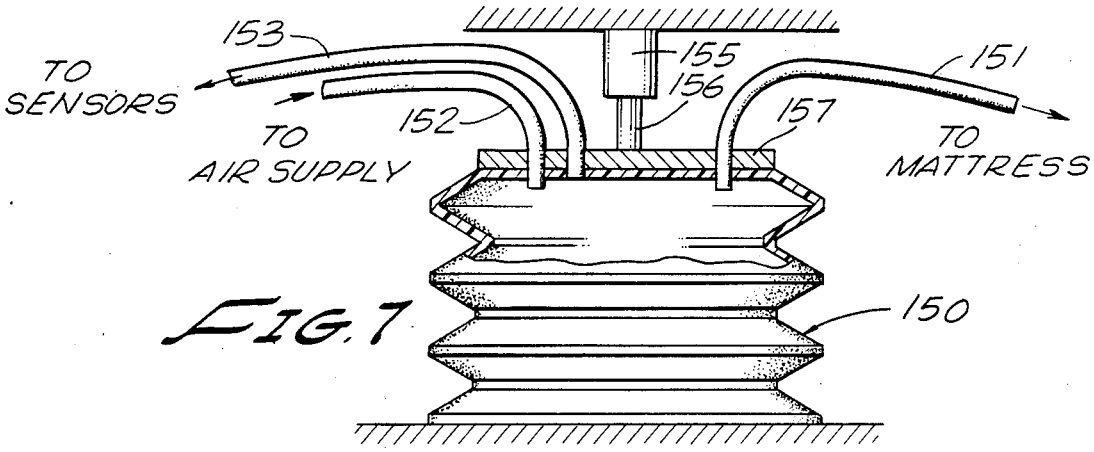
FIG. 7 shows a fifth embodiment of a portion of the air reservoir means and of the pressure-exerting means therefor.

FIG. 7 shows yet another embodiment of the pressure-exerting means for use in the embodiment of FIG. 1. Air flows from reservoir 150, similar to reservoir 1 in FIG. 1, to an airbed mattress via air line 151. Air flows into reservoir 150 via line 152 from an air-propelling means such as air pump 5 shown in FIG. 1. Air pressure detecting means in the airbed mattress, not shown in FIG. 7, transmits a signal representative of the air pressure in the airbed mattress on path 153 to a comparator. The comparator compares the actual pressure in the airbed mattress to the desired, selected pressure for the airbed mattress, and develops a signal representing the difference, if any, between the actual and the desired pressure. The difference signal is used to drive panel 157 atop reservoir 150 via piston shafts 155 and 156.

Figure 6:
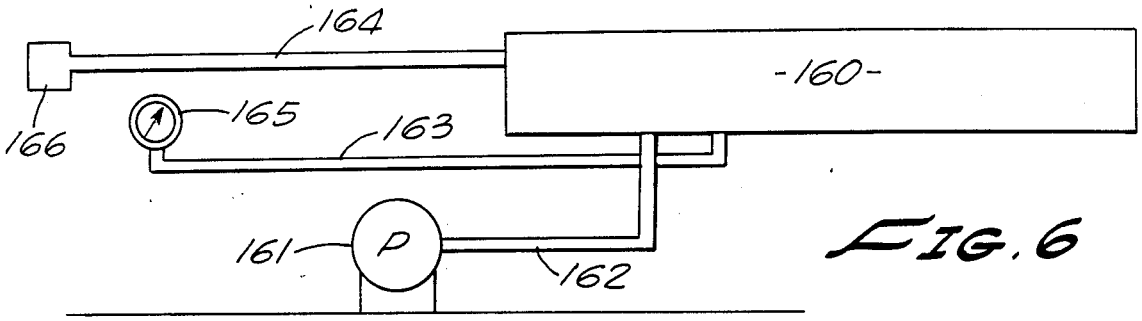
FIG. 6 shows an embodiment of the system without an air reservoir means, but including a pressure-sensing device combined with feedback loop circuit means for selecting and maintaining the desired pressure in an airbed mattress.
Figure 8:
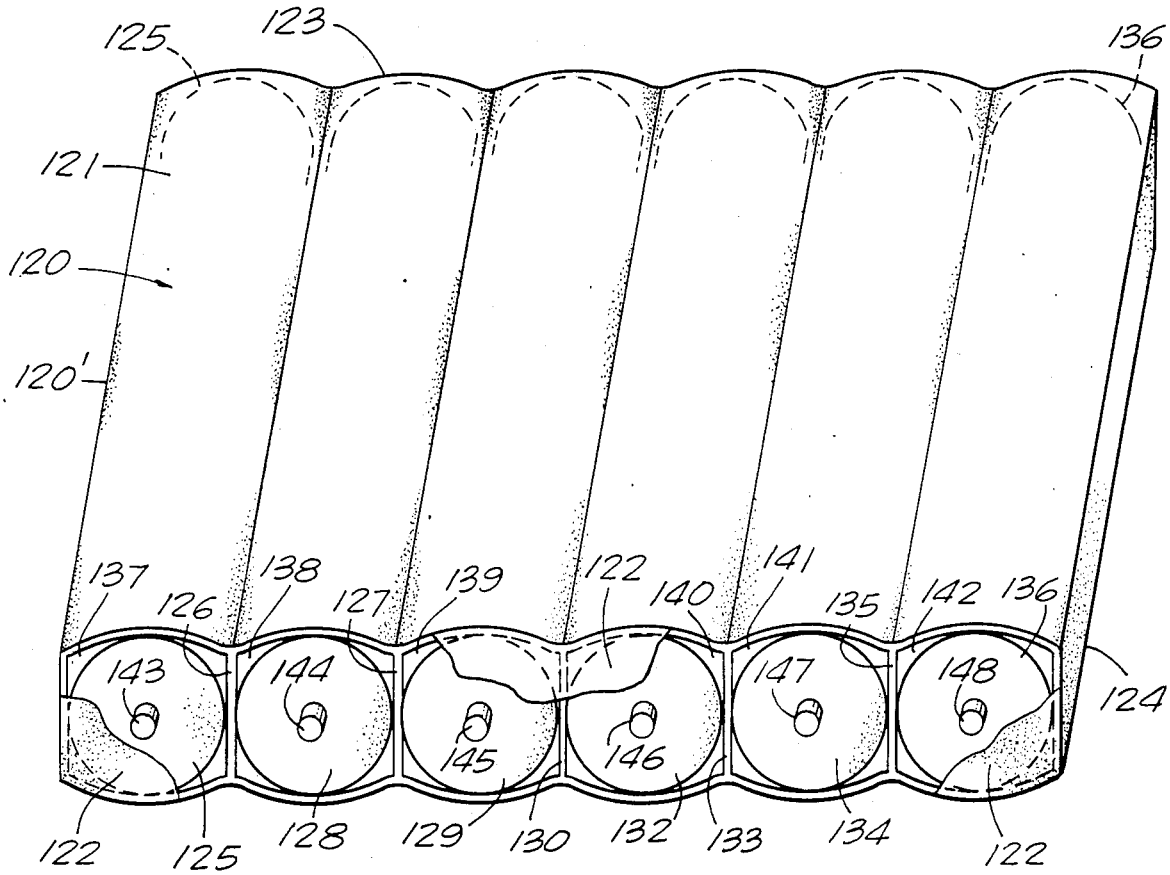
FIG. 8 shows another embodiment of an airbed mattress for use with the air reservoir means shown in FIGS. 1, 3, 4, 5, 6 and 7.

FIG. 6 shows an alternative embodiment of this invention which includes no air reservoir. Here, airbed mattress 160, such as one shown in FIG. 2 and FIG. 8, is linked to air pump 161 via path 162. The actual air pressure in airbed mattress 160 appears on pressure gauge 165, which is linked to mattress 160 by signal path 163. Path 164 carries a separate signal representative of the actual air pressure in airbed mattress 160 to air pressure sensing device 166. Sensing device 166 transmits this signal to a comparator device for comparing the actual air pressure in airbed mattress 160 to a desired, selected pressure, and develops a signal representing the difference between the two air pressures, if any. The difference signal is then used to activate air pump 161 if the pressure in airbed mattress 160 is below the desired pressure. If the pressure in airbed mattress 160 is above the desired pressure, then the difference signal is used to open a pressure release valve, not shown in FIG. 6, to reduce the pressure in airbed mattress 160 to the desired pressure.

FIGS. 2 and 8 show preferred embodiments of airbed mattresses for use with the air reservoir embodiments depicted in FIGS. 1, 3, 4, 5 and 7. Other airbed mattresses could be used if compatible with the air reservoir means of this invention. Preferably, this mattress lies atop, and is releasably fastened to, a container for the reservoir means, as shown in FIG. 1. The container functions as a box spring for the mattress. Preferably, the container opens to permit repair or other servicing of the reservoir means.

The airbed mattress of FIG. 2 includes bottom panel 31 to which are joined a plurality of pairs of straps such as 40–41 and 42–43 for holding, in side-by-side array, a plurality of individually sealed air tubes such as tubes 44, 45, 46, 47 and 48. Each of these tubes has a single inlet/outlet that can be linked to air manifold 7 through air passages 8, 9, 10 and 11. As FIG. 1 shows, manifold 7 preferably lies inside the mattress. Each of air passages 8, 9, 10 and 11 may include a check valve to prevent backflow and to facilitate identifying problems with the system.

Overlying bottom panel 31 is five-sided top panel 54 including side walls 55, 33, 35 and 37 linked to top panel 54. Interior structural support for airbed mattress 30 arises from interior, peripheral supporting panels 38, 36, 34 and 39. Zipper 32 holds the five-sided top panel 30 to bottom panel 31.

The airbed mattress of FIG. 8 includes top panel 121, a bottom panel of substantially the same size and shape, and four side panels 120, 122, 124 and 123 joining top panel 121 to the bottom panel to form mattress enclosure 120. Mattress enclosure 120 includes a plurality of parallel, longitudinal, cell-separating panels 126, 127, 130, 133 and 135 joining top panel 121 to the bottom panel of the mattress. Within the cells formed inside mattress enclosure 120 are air tubes 125, 128, 129, 132, 134 and 136. When inflated, as shown in FIG. 8, these air tubes substantially fill the cells inside mattress 120, and are separated from one another by panels 126, 127, 130, 133 and 135. Each of air tubes 125, 128, 129, 132, 134 and 136 is identical to the others, is self-contained, and includes an inlet/outlet opening, such as openings 143, 144, 145, 146, 147 and 148. A manifold as shown in FIG. 1 with its openings 8, 9, 10 and 11, can be linked to these openings in FIG. 8 to join the mattress to an air reservoir, as FIG. 1 shows.

The combination of one of the airbed mattresses depicted in FIGS. 2 and 8 with one of the air reservoir embodiments depicted in FIGS. 1, 3, 4, 5 and 7, maintains a predetermined, selectable air pressure in the mattress. The predetermined air pressure can be adjusted to satisfy a user's preference, as explained above. In operation, the combination maintains the predetermined, selected air pressure as one or more individuals occupy and leave the mattress.

When one or more persons lie upon the mattress, and the air reservoir of FIG. 1 is used in combination therewith, planar member 18 rises, increasing the air reservoir's volume by an amount equal to the decrease in volume in the mattress. If the increase in the reservoir's volume exceeds the predetermined limit, the air volume release valve opens, assuring constant pressure. Conversely, as one or more individuals vacate the mattress, planar member 18 falls to maintain the desired pressure throughout the system and to accommodate the increase in volume in the mattress. If the air demand for the mattress exceeds the available volume in the reservoir, planar member 18 falls to engage switch 22, turning on the air-propelling means to reinflate the reservoir and return the system of the predetermined, desired pressure.

This system provides a dynamic equilibrium between airbed mattress and air reservoir. Changes in temperature or in the load on the airbed mattress will cause a change in air volume in the reservoir, not in pressure in the system as a whole. However, the predetermined pressure can be varied as the user desires to provide different mattress firmnesses by moving the weight along a lever, as FIG. 5 shows.

The systems of this invention have many applications in addition to beds. Such systems could be incorporated in furniture, and in other support structures where automatic control of pneumatic pressure would be useful.

What is claimed is:

1. A system comprising an air mattress or an air cushion linked in direct air communication with an air reservoir means comprising a flexible container that includes air inlet means and air outlet means; means for propelling air through said air inlet means; means for exerting controllable pressure on said air reservoir means; means for starting said propelling means, and means for stopping said propelling means, said pressure exerting means being adapted to activate said starting means when the air volume in said reservoir falls below a predetermined minimum and to activate said stopping means when the air volume in said reservoir means rises above a first predetermined maximum.

2. The system of claim 1, said air reservoir means further comprising air volume relief means, said pressure-exerting means being adapted to activate means for opening said volume relief means when the air volume in said reservoir means rises to a second predetermined maximum, said second predetermined maximum being higher than said first predetermined maximum.

3. The system of claim 1 wherein said air reservoir means lies below a supporting platform for said air cushion or air mattress and wherein said air reservoir means is the air supply to said air cushion or said air mattress.

4. The system of claim 3 wherein said means for exerting controllable pressure on said air reservoir means comprises controllably-movable weight adapted to translate along said supporting platform, said supporting platform being movable in response to the exertion of force thereon by said movable weight.

5. The system of claim 1 wherein said pressure-exerting means is carried by a planar member that lies atop said reservoir means.

6. The system of claim 1 further comprising means for framing said air reservoir means wherein said starting means and said stopping means are linked to said framing means, and lie in the path of movement of said pressure-exerting means.

7. The system of claim 1 wherein said air mattress or air cushion is linked to said air reservoir means through said air outlet means.

8. The system of claim 7, said air mattress or said air cushion further comprising a planar surface linked to a plurality of means for holding a plurality of air tubes in a side-by-side relationship with each of said tubes linked to a common air manifold linked to the air outlet means of said air reservoir means.

9. The system of claim 1 further comprising means for controlling the pressure exerted by said pressure-exerting means.

10. The system of claim 1 wherein said means for exerting controllable pressure on said air reservoir means comprises movable weight means controllably linked to, and movable along pressure-transmitting means linked to said air reservoir means.

11. The system of claim 1 wherein said means for exerting controllable pressure on said air reservoir means comprises water-holding means lying atop said air reservoir means, said water-holding means having linked thereto means for controllably adding water to, and removing water from, said water-holding means.

12. A system comprising an air mattress or an air cushion linked in direct air communication with an air reservoir means, said air reservoir means comprising a flexible container that includes air inlet means and air outlet means; means for propelling air into said flexible container through said air inlet means, means for starting and stopping said propelling means; controllable, adjustable means for continuously maintaining a predetermined, substantially constant air pressure within said system; and means for maintaining the volume of air in said system above a predetermined minimum and below a predetermined maximum.

13. The system of claim 12 wherein said air mattress or air cushion includes means for detecting the actual air pressure in said system, means for generating a signal representative of said actual air pressure, means for comparing said signal representative of said actual air pressure to the desired, predetermined air pressure for said system, means for generating a signal representing the difference, if any, between said signal representative of the actual air pressure in said system and the desired, predetermined air pressure; and means for utilizing the difference signal for maintaining a predetermined, desired air pressure in said system.

14. The system of claim 12 further comprising pressure-exerting means adapted to activate said starting means when the air volume in said reservoir means falls below a predetermined minimum and to activate said stopping means when the air volume in said reservoir means rises to or above said predetermined maximum.

* * * * *